US005746873A

United States Patent [19]

Graf

[11] Patent Number: 5,746,873

[45] Date of Patent: May 5, 1998

[54] PROCESS FOR PRODUCING AN AIR MATTRESS WITH A PUMP PART AND A PART TO BE INFLATED

[76] Inventor: Josef Graf, Sagberg 1, 83112 Frasdorf, Germany

[21] Appl. No.: 722,016

[22] PCT Filed: Oct. 20, 1994

[86] PCT No.: PCT/EP94/03451

§ 371 Date: Nov. 27, 1996

§ 102(e) Date: Nov. 27, 1996

[87] PCT Pub. No.: WO95/28112

PCT Pub. Date: Oct. 26, 1995

[30] Foreign Application Priority Data

Apr. 18, 1994 [DE] Germany ..... 44 13 445.2

[51] Int. Cl.[6] ..... B32B 31/20; F04B 33/00; F04B 45/00

[52] U.S. Cl. ..... 156/274.4; 156/275.1; 156/308.4; 156/380.6; 5/708

[58] Field of Search ..... 5/708; 156/274.4, 156/275.1, 308.4, 380.4, 380.5, 380.6, 145, 146, 147

[56] References Cited

U.S. PATENT DOCUMENTS 4,574,026 3/1986 Winther ..... 156/275.1

5,244,526 9/1993 Johenning ..... 156/292

FOREIGN PATENT DOCUMENTS 2555881 6/1985 France .

4034593 7/1992 Germany .

9315105 3/1994 Germany .

59-033115 2/1984 Japan .

*Primary Examiner*—Michael W. Ball

*Assistant Examiner*—Michael A. Tolin

*Attorney, Agent, or Firm*—Jordan and Hamburg

[57] ABSTRACT

The invention relates to a method of producing an air mattress, which comprises a pump part and a part, which is to be pumped up. A propellant is disposed in the pump part and the wall, which separates the pump part from the part, which is to be pumped up, has a one-way valve and a small opening, through which air can flow back from the part, which is to be pumped up, into the pump part. An inlet opening is disposed in the pump part and an outlet opening is disposed in the part, which is to be pumped up. Pursuant to the invention, a metallic tool is used for welding the pump part wall between the upper and lower covering skins of the air mattress. The tool forms one part of a high-frequency welding machine, having two plates, which lie against the outside of the covering skins. The tool is removed before the edge seals of the air mattress are produced. When the pump part is disposed within the air mattress, a dividable tool is used.

17 Claims, 6 Drawing Sheets

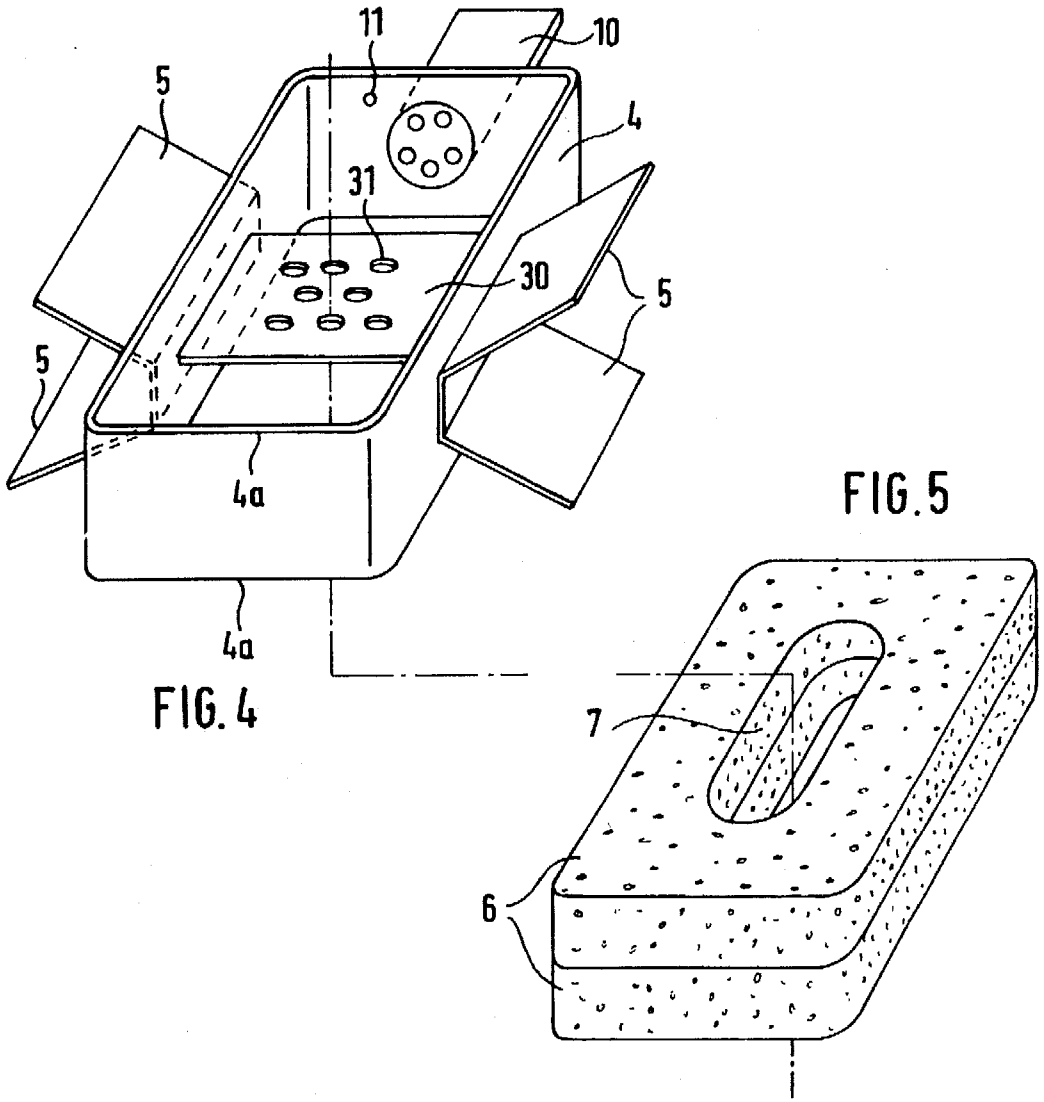
FIG. 4
FIG. 5
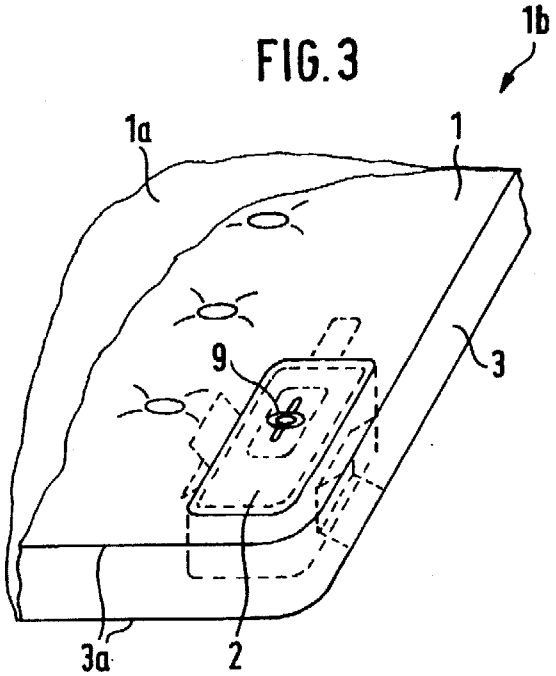
FIG. 3

FIG.6
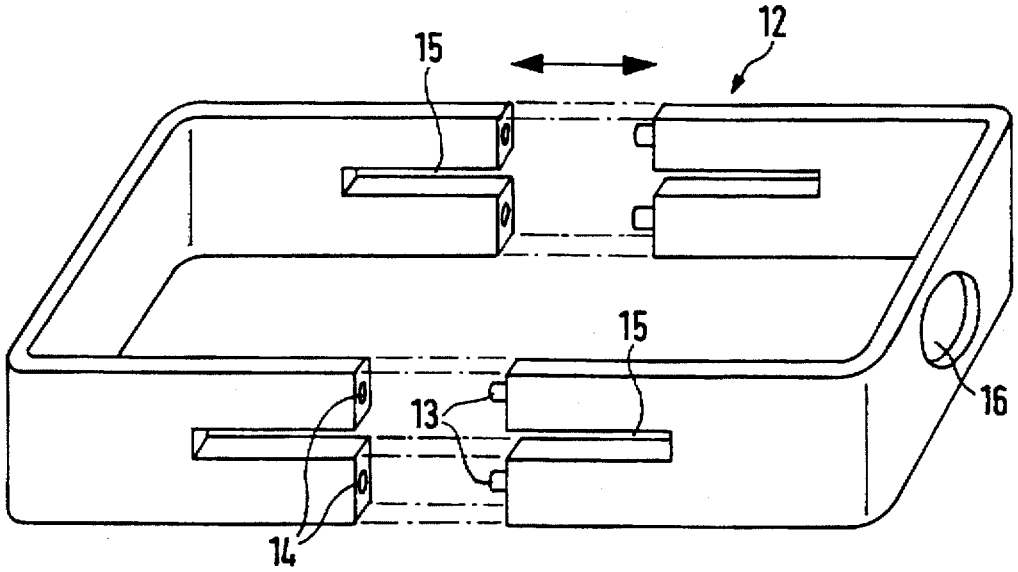
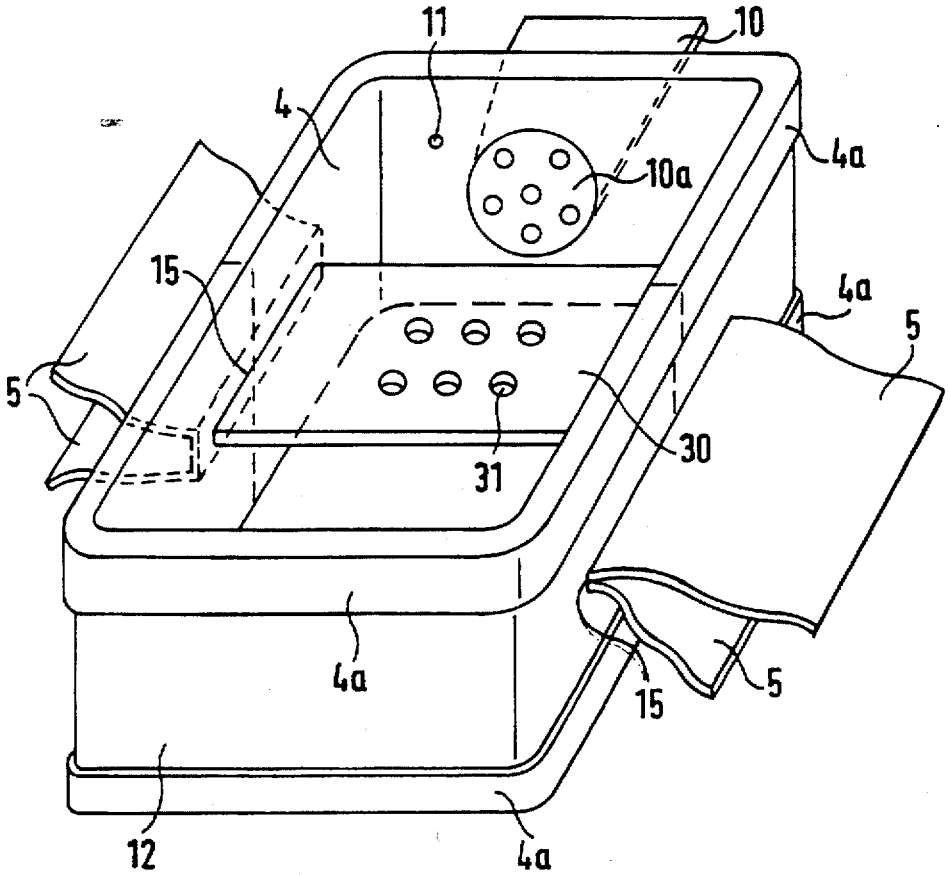
FIG.7

PROCESS FOR PRODUCING AN AIR MATTRESS WITH A PUMP PART AND A PART TO BE INFLATED

BACKGROUND OF THE INVENTION

The invention relates to a method for producing an air mattress with one part, which acts as a pump and one part, which is to be inflated by the pump.

An air mattress with these features is known, for example, from WO 94/03089. In the known air mattress, air can enter the interior of the pump part through the inlet opening by opening up said opening. When air is admitted, the propellant material accommodated in the pump part increases in volume until the pump part is to some extent filled with air. Now the pump part is compressed, for example, by the foot of the user, so that the foot closes the inlet opening. Now air passes into the inflatable part through the one-way outlet valve. This pumping process is repeated until the inflatable part is inflated somewhat more than is ultimately desired. If the pumping action is then stopped and the inlet opening closed, some of the air flows back into the pump part through the small opening, until the same pressure prevails in the closed system formed by the pump part and by the inflatable section. With that, the mattress is ready for use. To empty the air mattress, the outlet opening is opened. By rolling up the air mattress starting from the pump part, the air is removed from both the pump part as well as from the inflatable part, in that it emerges through the outlet opening. The propellant material is understood to be a compressible material, which increases in volume upon the admission of air. An open-celled synthetic foam material, for example, is such a material.

The aforementioned publication does not disclose the method of making the mattress and specifically not the method of welding-in the wall separating the pump part from the part to be inflated.

It is therefore an object of the invention to enable the mattress to be produced and, in particular, to enable the pump part wall to be welded in place in an especially economical manner.

SUMMARY OF THE INVENTION

By inserting a metallic tool between the plates of the high frequency welding machine, it is ensured that a current flows over this tool and causes the thermoplastic films, inserted between a plate and the tool, to be heated and, hence, welded. After the welding of the pump part wall, the tool is removed and only subsequently are the edges of the covering skin bonded together.

Above all, it is important in this connection that, when the pump part is disposed inside the air mattress, a film, which is frame-like in plan view, and a tool, which is also frame-like, are used. In this case, the tool must be dividable, as it could otherwise not be removed.

A tool, which is not dividable, may be used when the pump part is disposed in a corner of the air mattress.

BRIEF DESCRIPTION OF THE DRAWINGS

The invention is explained in greater detail in the following by means of the embodiments shown in the drawing, in which FIG. 3 shows a perspective view of an air mattress, which is partially cut open, with a pump part lying inside the mattress, FIG. 4 shows a perspective view of the pump part wall, which is to be welded between the covering skins, FIG. 5 shows a perspective view of a block of the propellant material, which is to be inserted into the pump part, FIG. 6 shows a perspective view of the tool used, FIG. 7 shows a perspective view of the operational part formed by the elements shown in FIGS. 4 and 6.

DETAILED DESCRIPTION OF THE DRAWINGS

Figure 1:
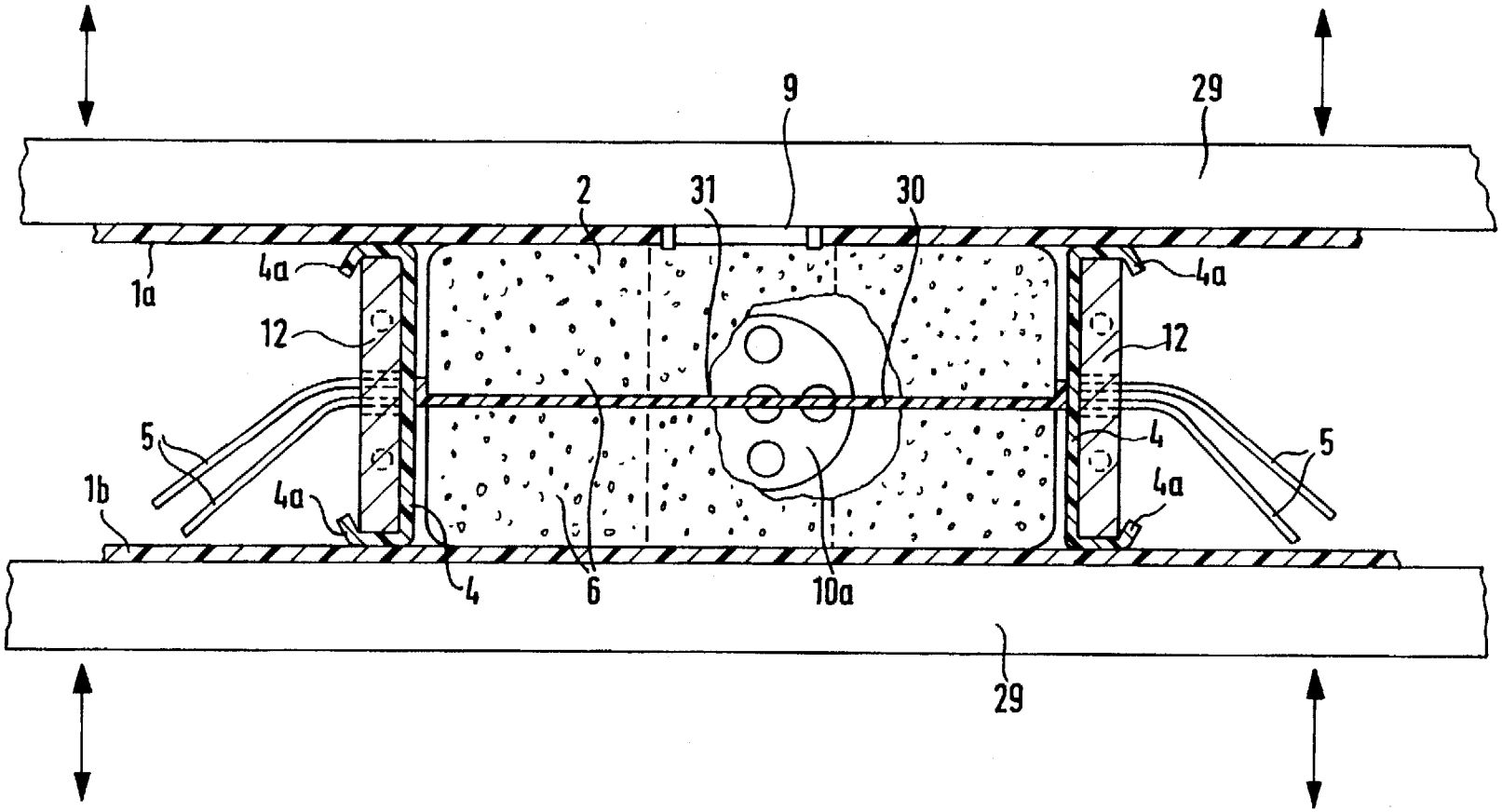
FIG. 1 shows a cross section through the pump part during the welding-in process.

FIG. 1 illustrates the welding-in of the pump part wall 4 in the embodiment shown in FIGS. 1 to 7.

Plates 29 of a high frequency welding machine, which can be moved in the direction of the arrows, abut the outside of the covering skins 1*a* and 1*b* of the air mattress 1. Between the covering skins, there is a metallic tool 12 in the form of a web. Abutting the inside of the tool 12 is the wall 4, which consists of a thermoplastic film and the top and bottom edges 4*a* of which are bent over the edges of the tool 12. The edges 4*a* lie between the tool 12 and the upper covering skin 1*a* or respectively the lower covering skin 1*b*. On the top side of the pump part 2, there is an inlet opening 9 formed in the covering skin 1*a*. The inlet opening 9 can also readily lie on the opposite side.

In the pump part 2, there is a block 6 formed from a propellant material, more especially an open-celled foam material.

Web lugs 5, which are connected to the wall 4 and, in a later stage of the method, will be still connected diagonally to the upper covering skin 1*a* or the lower covering skin 1*b*, protrude at both sides of the tool 12. The web lugs 5 serve to prevent the wall 4 from indenting as the pressure in the part to be inflated increases.

In order to prevent bulging, oppositely situated walls 4 are interconnected by a tensioning lug 30. If a block 6 of propellant material is used, it must be divided.

The block 6, shown partially cut open, exposes the inlet opening 10*a* of a one-way outlet valve in the form of a film valve 10.

Figure 2:
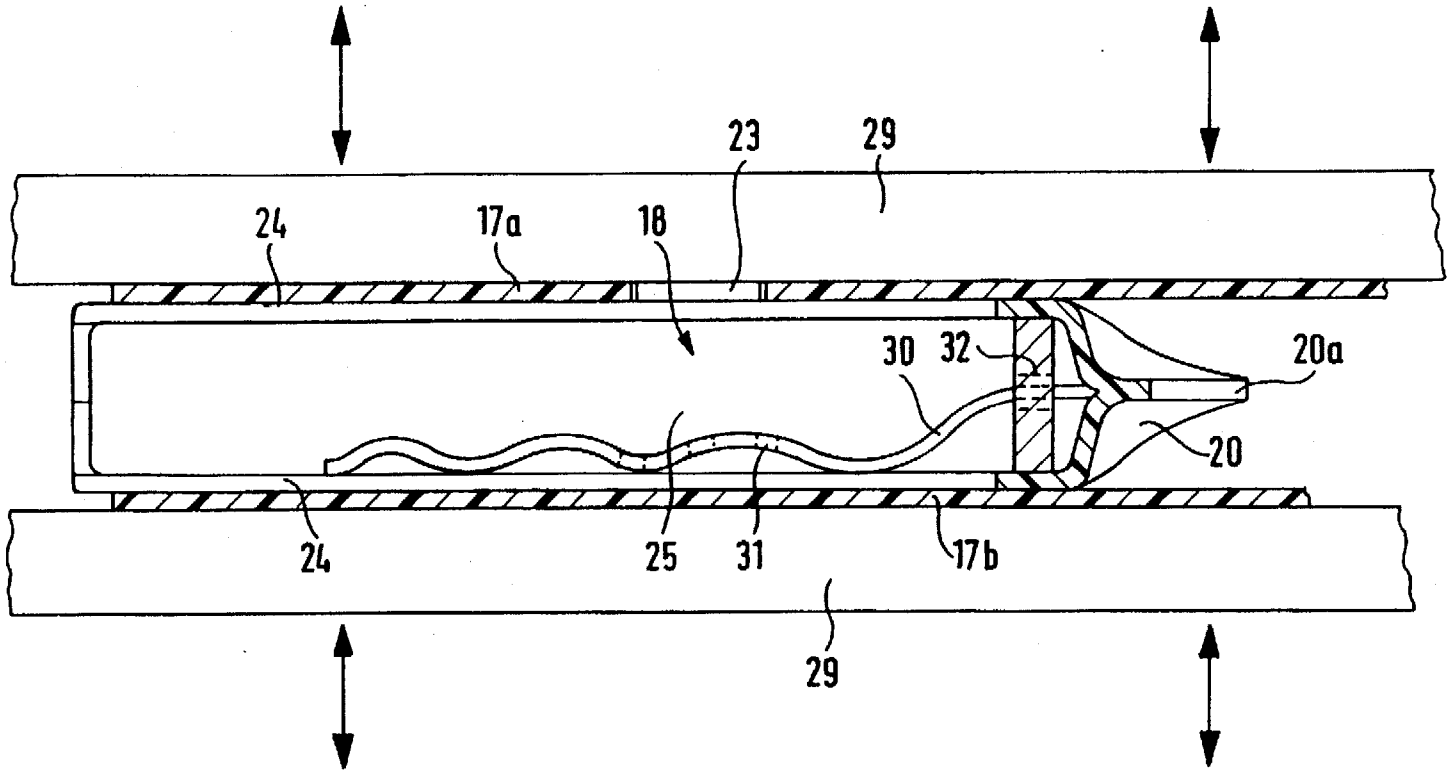
FIG. 2 shows a section through the pump part, perpendicular to FIG. 1.

FIG. 2 is a view, corresponding to that of FIG. 1, for the welding-in of the pump part wall 20 when a pump part is disposed in a corner of the air mattress. The wall 20 is formed here from two strips of film, which are joined together by a welded seam 20*a* on a longitudinal edge. The edges of the strips of film overlap the upper and the lower edges of a tool 25. The upper covering skin 17*a* and the lower covering skin 17*b* respectively lie between the plates 29 and the respective edge of the strip of film. The covering skin and the edge of the strip of film are joined by a welded seam 24.

The inlet opening 23 has a seal, which is not shown.

At the same time, the free end of a tensioning lug 30, which extends through a slot 32 in the tool 25, is secured by the welded seam 20*a*. When the welded seam 19 is produced, the other end of the tensioning lug 30 is welded to the edge of the air mattress 1 so that the tensioning lug 30 is somewhat taut. The tensioning lug 30 has holes 31 in its central region.

As FIG. 3 shows, when the pump part 2 is disposed inside the air mattress, the edges of the covering skins 1*a* and 1*b* are connected to a peripheral side wall 3 of the air mattress by welded seams 3*a*. The pump part 2 is disposed near the edge of the air mattress, so that the user can stand with one leg on the ground while pumping.

FIG. 4 shows the wall 4 of the pump part 2 in the configuration after the air mattress 1 has been inflated. The edges 4*a* of the wall 4 are joined to the upper covering skin 1*a* and to the lower covering skin 1*b*, as are the free edges of the tensioning lugs 5.

The small opening 11 ensures that there is a small backflow of air, in order to produce the desired equalization of pressure between the pump part 2 and the inflatable part.

The block 6, shown in FIG. 5, has a central, continuous recess 7, which is situated opposite the inlet opening 9 and ensures that the inlet opening 9 cannot be closed inadvertently by the block 6. The division of the block 6 by using the tensioning lug 30 is also indicated in this Figure.

The tool 12, shown in FIG. 6, is divided along a plane perpendicular to the subsequent plane of the air mattress 1. In both parts, there are portions of the slots 15, through which the web lugs 5 are passed. The parts of the tool 12 can be centered relative to each other by bolts 13 on the end faces of the one part and by corresponding holes 14 in the end face of the other component part. The film valve 10 is passed through the borehole 16.

FIG. 7 shows the operational part, formed by the wall 4 and the tool 12, as introduced between covering skins 1*a* and 1*b*. It can be seen especially clearly here how the edges 4*a* of the wall 4 are bent over the edges of the tool 12. The bent-over edges 4*a* are easily deformable, so that there is no difficulty in removing the tool 12.

Figure 8:
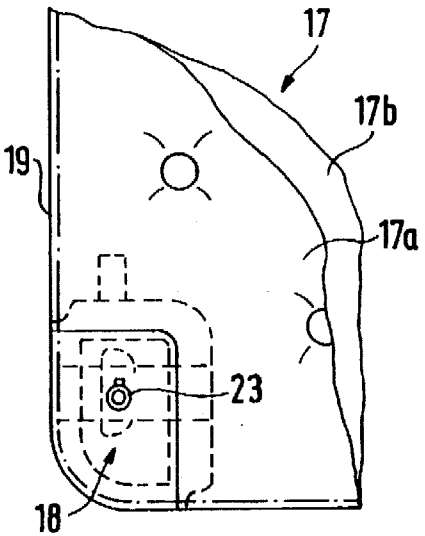
FIG. 8 shows a plan view of a mattress, which is partially cut open, with a pump part disposed in a corner of the mattress.
Figure 9:
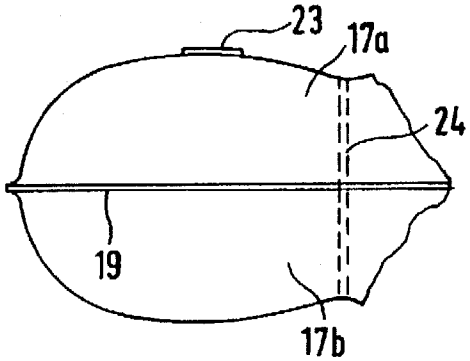
FIG. 9 shows a side view of the object of FIG. 8.

According to FIG. 8, the pump part, here numbered 18, is disposed in the corner of an air mattress section 17. The upper covering skin 17*a* and the lower covering skin 17*b* are joined together at the edge by a peripheral welded seam 19, so that the bonded covering skins form, at the same time, portions of the side wall of the pump part 18. The inlet opening 23 is in the upper covering skin 17*a*, as can be seen especially in FIG. 9. The welded seam 24, at which the pump part wall 20 is joined to the covering skins 17*a* and 17*b*, is also shown there.

Figure 10:
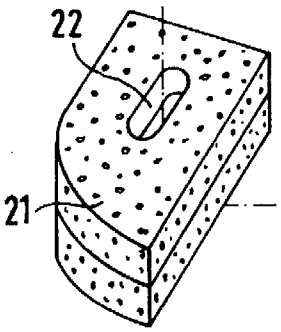
FIG. 10 shows a perspective view of a block of the propellant material to be inserted into the pump part.

FIG. 10 shows that the block 21 of the propellant material, which is to be inserted in the pump part 18, has a recess 22 and is divided by the use of a tensioning lug 13, like block 6 in FIG. 5. Advisably, the block 21 is inserted into the pump part 18 only after the wall 20 has been welded in position. This is possible because the pump part 18 is open at the side before the welded seam 19 is produced.

Figure 11:
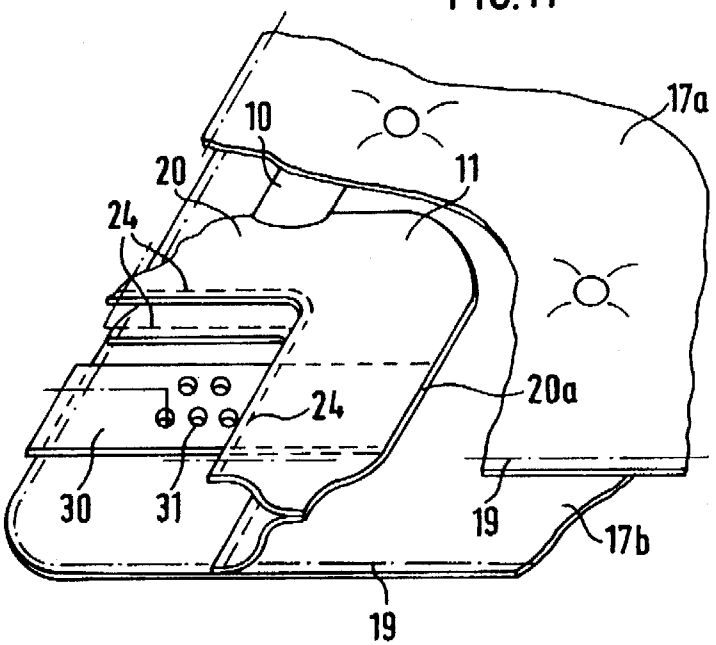
FIG. 11 shows a perspective view showing the position of the pump part wall prior to the welding process.

FIG. 11 shows that the wall 20 comprises two strips of film, which are joined together at a longitudinal seam by a welded seam 20*a*. The wall 20 is joined to the covering skins 17*a* and 17*b* along the welded seam 24. During the internal welding process, the edges of the tool 25 are positioned at this welded seam.

Figure 12:
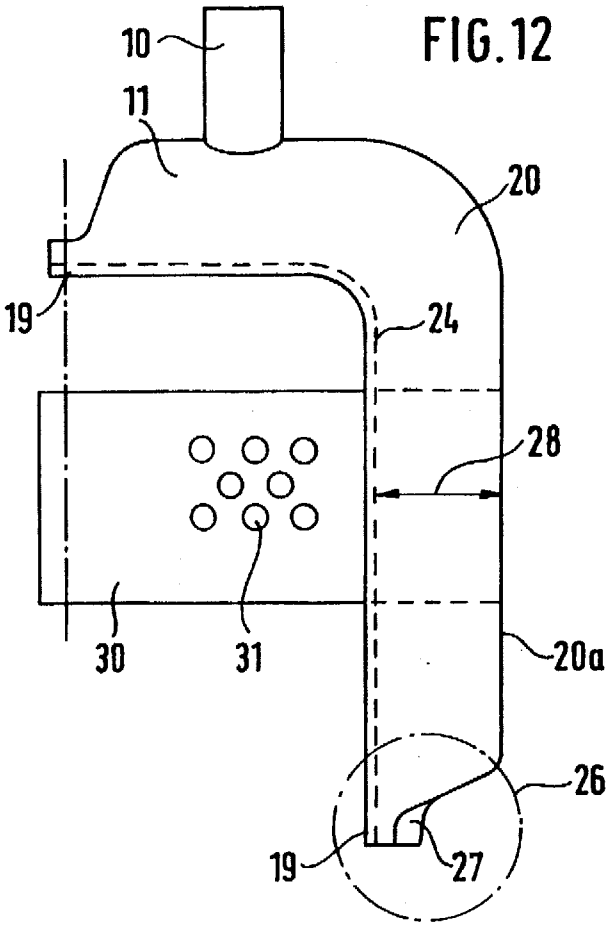
FIG. 12 shows a plan view of the pump part wall of FIG. 11

FIG. 12 also shows that the width of the strips of film, forming the wall 20, decreases in the transitional region 26 to the edge of the air mattress defined by the welded seam 19. This corresponds to the decrease in height of the air mattress in its inflated state. In this region, the strips of film have a nominal extension site 27 in the form of a short incision with a small borehole, in order to prevent tearing of the very thin strips of film.

The free ends of the strips of film are welded together by means of the welded seam 19. At this point, therefore, four films lie on one another for the production of the welded seam 19, namely, the covering skins 17*a* and 17*b* as well as the film strips forming the wall 20.

The height of the inflated air mattress is determined by the distance 28 between welded seam 24 and welded seam 20*a*, because the strips of film are aligned during the inflation and twice the distance 28 then corresponds to the distance between the covering skins 17*a* and 17*b*. The height of the inflated mattress can therefore be determined by varying the distance 28.

Figure 13:
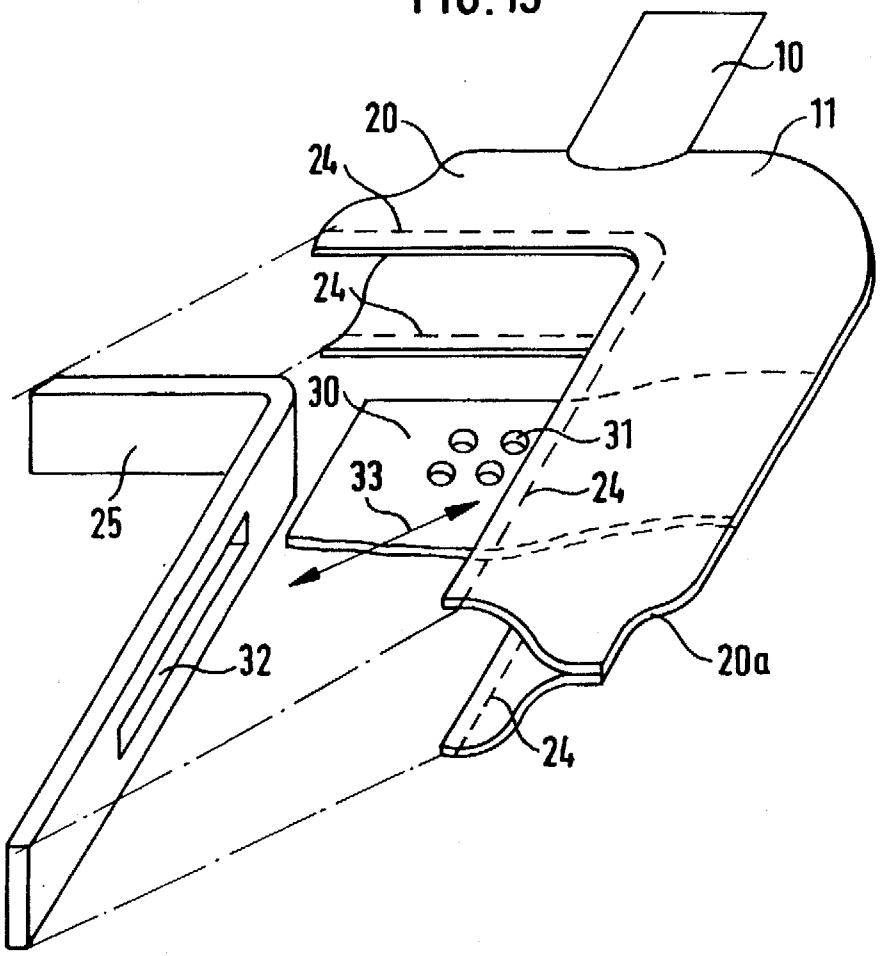
FIG. 13 shows a perspective view of the pump part wall with the tool, which is to be positioned therein.

From FIGS. 12 and 13, it is apparent that one end of a tensioning lug 30 is secured to the pump part wall 20 by the welded seam 20*a*.

In FIG. 13, the arrow 33 show how the tool is introduced between the strips of film of the wall 20 and removed again after the wall 20 has been welded-in between the covering skins 17*a* and 17*b*.

I claim:

1. A method of producing an air mattress having a pump and an inflatable part, wherein the pump has an inlet opening, which can be closed off, and the pump is connected to the inflatable part by a one-way outlet valve, the pump has a propellant material for biasing the pump into an expanded state and said inflatable part has an outlet opening for deflation, the method comprising the steps of:

forming upper and lower covering skins of the air mattress from thermoplastic material;

forming a pump wall of said pump part from thermoplastic material, the pump wall having opposite sides with web lugs extending from an exterior surface of said pump wall;

disposing said upper and lower covering skins parallel to one another and between an upper and a lower plate of a high frequency welding machine;

providing a metallic sealing die tool having die walls conforming to at least a portion of an outside perimeter of an installed state of said pump wall and extending substantially perpendicularly with respect to said upper and lower covering skins, the sealing die tool being divided into first and second die parts which are connectable together to encircle said pump and having slots for accepting said web lugs, said slots communicating with connectable edges of said first and second die parts;

disposing said pump wall over an inside surface of said die walls with upper and lower edges of said pump wall being folded over upper and lower surfaces of said die walls and inserting said web lugs through said slots in the sealing die tool;

interposing said sealing die tool with said pump wall disposed thereon between the upper covering skin and the lower covering skin;

pressing the upper and lower plates together to clamp said upper and lower edges of said pump wall in contact with said upper and lower covering skins;

applying a high frequency power source to said upper and lower plates to weld said upper and lower edges of said pump wall to the upper covering skin and the lower covering skin, respectively;

separating said first and second die parts and removing said sealing die tool from between said upper and lower covering skins after the welding process; and joining said web lugs in diagonal directions to the upper covering skin and to the lower covering skin.

2. The method of claim 1, wherein a film valve is provided in one side of the pump wall and said sealing die tool is provided with an opening in said die walls through which said film valve is inserted during said disposing of said pump wall over said inside surface of said die walls.

3. The method of claim 1, wherein said propellant material is a block and is inserted within said pump wall before the pump wall is welded.

4. The method of claim 1, wherein the propellant material is in the form of material pieces and is inserted into the pump through the inlet opening.

5. The method of one of the claim 1, wherein said joining said upper and lower covering skins includes welding a side wall between the upper covering skin and the lower covering skin.

6. The method of claim 5, wherein joining said web lugs includes welding free edges of the web lugs between said side wall and said upper and lower covering skins.

7. The method of claim 6, wherein said joining said web lugs includes inserting a second die tool between free edges of other ones of said web lugs such that said free edges are pressed into contact with said upper and lower covering skin and welding said free edges to said upper and lower covering skins simultaneously with the welding of the pump wall to the upper covering skin and the lower covering skin.

8. The method of claim 1 further comprising joining a tensioning lug between opposite sections of the pump wall to fix mutual distance between the opposite sections.

9. The method of claim 7 wherein said second die tool is connected with the sealing die tool.

10. A method of producing an air mattress having a pump and an inflatable part, wherein the pump has an inlet opening, which can be closed off, and the pump is connected to the inflatable part by a one-way outlet valve, the pump has a propellant material for biasing the pump into an expanded state and said inflatable part has an outlet opening for deflation, the method comprising the steps of:

forming upper and lower covering skins of the air mattress from thermoplastic material;

forming a pump wall of said pump part from thermoplastic material;

disposing said upper and lower covering skins parallel to one another and between an upper and a lower plate of a high frequency welding machine;

providing a metallic sealing die tool having die walls conforming to at least a portion of an outside perimeter of an installed state of said pump wall and extending substantially perpendicularly with respect to said upper and lower covering skins;

disposing said pump wall over an inside surface of said die walls with upper and lower edges of said pump wall being folded over upper and lower surfaces of said die walls;

interposing said sealing die tool with said pump wall disposed thereon between the upper covering skin and the lower covering skin;

said interposing said sealing die tool with the pump wall disposed thereon including disposing said sealing die tool in a corner of the air mattress and the sealing die tool extending between contiguous edges of the air mattress pressing the upper and lower plates together to clamp said upper and lower edges of said pump wall in contact with said upper and lower covering skins;

applying a high frequency power source to said upper and lower plates to weld said upper and lower edges of said pump wall to the upper covering skin and the lower covering skin, respectively;

removing said sealing die tool from between said upper and lower covering skins after the welding process; and joining the upper and lower covering skins to seal said air mattress.

11. The method of claim 10, wherein said sealing die tool is L-shaped.

12. A method of producing an air mattress having a pump and an inflatable part, wherein the pump has an inlet opening, which can be closed off, and the pump is connected to the inflatable part by a one-way outlet valve, the pump has a propellant material for biasing the pump into an expanded state and said inflatable part has an outlet opening for deflation, the method comprising the steps of:

forming upper and lower covering skins of the air mattress from thermoplastic material;

forming a pump wall by welding together two strips of thermoplastic film to form a welded seam at one longitudinal edge;

disposing said upper and lower covering skins parallel to one another and between an upper and a lower plate of a high frequency welding machine;

providing a metallic sealing die tool having die walls conforming to at least a portion of an outside perimeter of an installed state of said pump wall and extending substantially perpendicularly with respect to said upper and lower covering skins;

disposing said pump wall over an inside surface of said die walls with upper and lower edges of said pump wall being folded over upper and lower surfaces of said die walls;

interposing said sealing die tool with said pump wall disposed thereon between the upper covering skin and the lower covering skin;

pressing the upper and lower plates together to clamp said upper and lower edges of said pump wall in contact with said upper and lower covering skins;

applying a high frequency power source to said upper and lower plates to weld said upper and lower edges of said pump wall to the upper covering skin and the lower covering skin, respectively;

removing said sealing die tool from between said upper and lower covering skins after the welding process; and joining the upper and lower covering skins to seal said air mattress.

13. The method of claim 12, wherein said one-way outlet valve is a the film valve and further comprising welding said film valve between the two strips of thermoplastic film prior to disposing said pump wall on said sealing die tool.

14. The method of claim 10, wherein ends of the pump wall are welded by means of peripheral welded seam formed during said joining the upper and lower covering skins wherein edges of said upper and lower covering skins are welded together.

15. The method of claim 14, wherein said two strips each are formed having a width which decreases towards the ends of the pump wall to accommodate a curvature defined by said upper and lower covering skins following said joining of said upper and lower covering skins.

16. The method of claims 12, further comprising connecting one end of a tensioning lug to an interior section of the pump wall and joining another end of said tensioning lug to an edge of the air mattress during said joining of said upper and lower covering skins.

17. The method of claim 16, wherein said connecting the tensioning lug to the pump wall includes welding said one end between the two strips of thermoplastic film during forming the pump wall and said joining another end of the tensioning lug includes welding said another end in a welded seam formed by welding edges of the upper and lower covering skins to one another.

* * * * *